US007743529B2

(12) United States Patent
Thompson

(10) Patent No.: US 7,743,529 B2
(45) Date of Patent: Jun. 29, 2010

(54) PROTECTIVE FOOT COVERING ARTICLE

(76) Inventor: Seth Otto Thompson, 9009 Great Hills Trail # 2325, Austin, TX (US) 78759

( * ) Notice: Subject to any disclaimer, the term of this patent is extended or adjusted under 35 U.S.C. 154(b) by 785 days.

(21) Appl. No.: 11/643,214

(22) Filed: Dec. 21, 2006

(65) Prior Publication Data

US 2008/0148604 A1 Jun. 26, 2008

(51) Int. Cl.
*A43B 7/06* (2006.01)

(52) U.S. Cl. ..... 36/3 R; 36/7.4

(58) Field of Classification Search ..... 36/3 R, 36/7.4, 7.7, 7.3, 8.1, 4
See application file for complete search history.

(56) References Cited

U.S. PATENT DOCUMENTS 1,537,778 A * 5/1925 Nyhagen ..... 36/7.3
1,724,450 A * 8/1929 Callahan ..... 36/3 A
2,185,762 A * 1/1940 Cox ..... 36/8.1
2,389,414 A * 11/1945 Crofut, Jr. ..... 36/10
2,463,296 A * 3/1949 Moore ..... 36/10
2,497,528 A * 2/1950 Baker ..... 36/10
2,627,126 A * 2/1953 France ..... 36/9 A
5,822,884 A * 10/1998 Roeder ..... 36/7.1 R
6,833,171 B2 * 12/2004 Campbell et al. ..... 428/36.8

* cited by examiner

*Primary Examiner*—Jila M Mohandesi
(74) *Attorney, Agent, or Firm*—David O. Simmons

(57) ABSTRACT

A protective foot covering article comprises two adjacent layers of water impermeable sheet material. A water impermeable seam is provided between the layers of water impermeable sheet material. A shape of the water impermeable seam provides for an interior space between the layers of water impermeable sheet material. The interior space includes a closed end portion and an open end portion. A portion of the water impermeable seam defining the closed end portion of the interior space is contoured inwardly with respect to the interior space thereby providing a contoured foot arch portion. A plurality of water drainage apertures each extending through at least one of the layers. Means for cinching the open end portion of the interior space is engaged with at least one of the layers of water impermeable sheet material.

20 Claims, 3 Drawing Sheets

FIG. 1
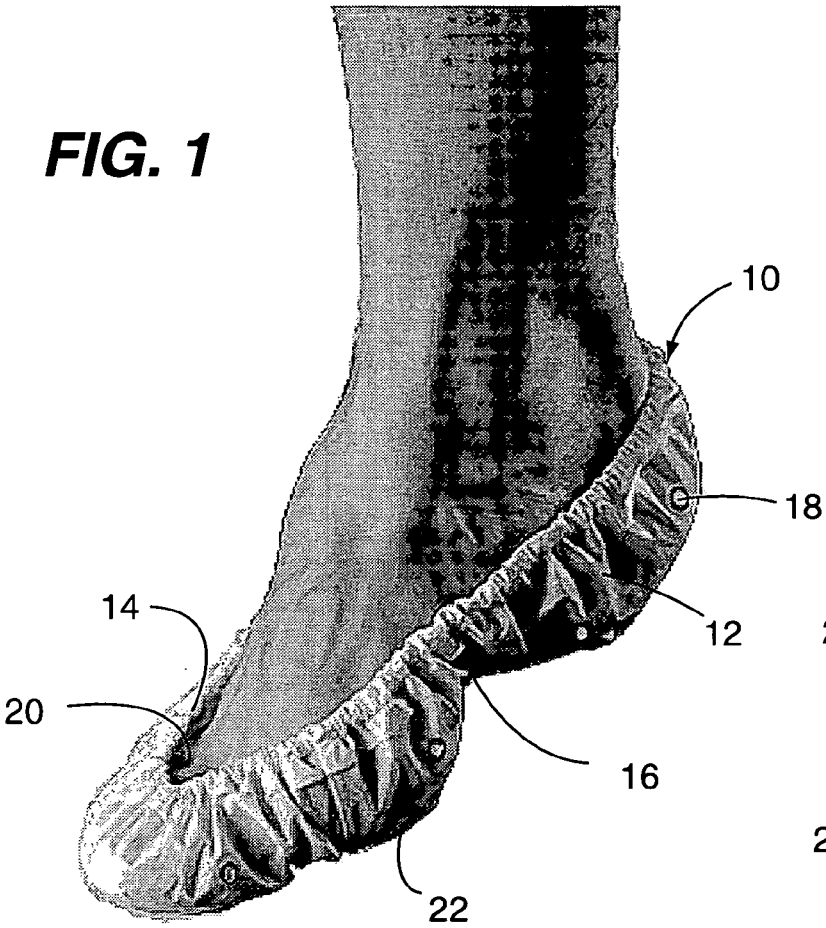
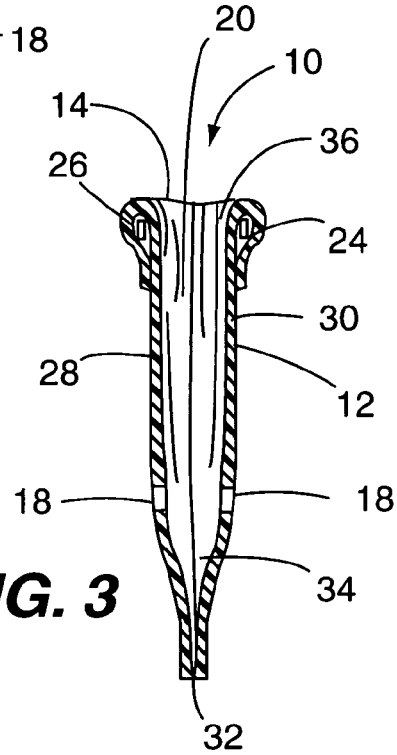
FIG. 3
FIG. 2
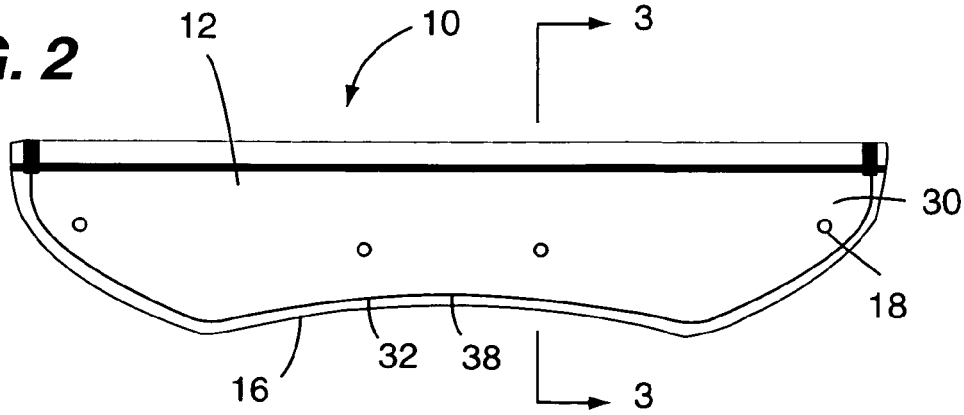

PROTECTIVE FOOT COVERING ARTICLE

FIELD OF THE DISCLOSURE

The disclosures made herein relate generally to protective foot covering implements and, more particularly, to one-time use foot covering implements that are configured for providing a protective barrier between a person's foot and an underlying floor surface that is contaminated with undesirable matter and for providing anti-slip protection.

BACKGROUND

It is well known that walking barefoot in public and private facilities such as, for example, showers, fitness centers, locker rooms, swimming pool areas, and hospital rooms often leads to fungal-related foot ailments. Examples of such fungal-related foot ailments include, but are not limited to, Athletes Foot, Plantar Wart and the like. In addition to the potential of being subjected to such fungal-related foot ailments, there is also the potential for floors of such public and private facilities to be contaminated with micro and macro biological matter such as, for example, hair, medical chemicals, blood, urine, fecal matter, nasal discharge, stale water and the like. Accordingly, the thought of walking barefoot on floor surfaces in such public and private facilities is enough to make many people wary of using such public and private facilities. At a minimum, people often where their 'street shoes' as opposed to walking barefoot on floor surfaces in such public and private facilities, even in instances where wearing their street shoes may be seemingly awkward or inappropriate.

In an effort to quell concerns of walking barefoot in such public and private facilities, harsh cleaning substances are often used in an attempt to clean and sanitize floors in public and private facilities on which people often walk barefoot. Granted, the regular use of such harsh cleaning substances does go a long way to providing an environment in which a person is less prone to their bare feet being exposed to fungal and biological matter on floor surfaces. However, incomplete removal (e.g., rinsing) of such harsh cleaning substances has been known to cause skin irritation on a person's feet.

Disposable, one-time use foot covering implements are sometimes made available to patrons of certain business establishments for the purpose of proactively addressing concerns of walking barefoot on unclean floor surfaces. One example of such a disposable, one-time use foot covering implement is a one-time use 'flip-flop' sandal that has a sole made of a hard paper material and a strap attached to the sole for securing the sole to a foot. However, the design and construction of such conventional one-time use foot covering implements exhibit one or more characteristics that limitation their effectiveness and/or desirability. Examples of such limitations include, but are not limited to, providing less than desirable protection in a broad range of conditions, being relatively expensive, providing less than desirable protection, being somewhat difficult to walk in and/or not suitably fitting a broad range of foot sizes.

Therefore, a protective foot covering article that is configured for single use in protecting a person's bare feet from direct contact with unclean floor surfaces and that overcomes limitations associated with known approaches and articles for protecting a person's bare feet from unclean floor surfaces would be advantageous, desirable and useful.

SUMMARY OF THE DISCLOSURE

Embodiments of the present invention protect a wearer's bare feet from unsanitary floor surfaces, thereby creating a barrier between the wearer's feet and contaminants that are regularly found on public floor surfaces. Furthermore, embodiments of the present invention reduce the potential for slipping and falling in wet environments. Broadly, a protective foot covering article in accordance with the present invention is a simplistic polymer article that slips over a foot and is held to the foot by means such has, for example, an elastic band. Water drainage apertures (also referred to herein as portholes) allow for water to drain out of the protective foot covering article should excess water gather therein (e.g., in the case of the wearer standing under a showerhead). Preferably, but not necessarily, a protective foot covering article in accordance with the present invention is disposable and lightweight in addition to being configured such that one size fits most adult users and such that there is no correct "front" or "back." Thus, such a protective foot covering article is simple to use and provides sufficient sanitary protection and slip resistance qualities beneficial to a wearer.

Protective foot covering articles in accordance with the present invention offer several benefits over known solutions to the problem of protecting bare feet from biological and chemical contaminants and reducing the potential for slipping on wet floor surfaces. Disposability and relatively low cost of manufacture provide for a price structure that allows establishments to offer such protective foot covering articles to clients as a complimentary amenity. As clients of establishments often forget to bring their own shoes or sandals (e.g., flip-flops), availability of such a complimentary amenity is advantageous to both the establishment and the client. Furthermore, disposability is beneficial, as contaminants are not transferred from floor surfaces to lockers, gym backs, cars, etc via a clients shoes or sandals. Ultimately, protective foot covering articles in accordance with the present invention heighten the sense of enjoyment in walking 'barefoot' in public facilities, heightened customer satisfaction and perception of upscale service, significantly reduce customer complaints (e.g., associated with cleanliness and adverse foot ailments such as Athlete's Foot) and limit legal negligence/liability lawsuits (e.g., by suggesting customers without sandals use complimentary protective foot covering articles).

In one embodiment of the present invention, a protective foot covering article comprises a foot cover body made from water impermeable sheet material. The foot cover body includes a foot-receiving opening therein, a contoured foot arch portion positioned generally opposite the foot-receiving opening and at least one water drainage aperture extending through the foot cover body.

In another embodiment of the present invention, a protective foot covering article comprises a foot cover body made from water impermeable sheet material and a strip of resilient material. The foot cover body has an interior space accessible through a foot-receiving opening of the foot cover body. At least one water drainage aperture extends through the foot cover body. The foot cover body includes a contoured foot arch portion positioned generally opposite the foot-receiving opening. The strip of resilient material extends at least partially around the foot-receiving opening. The strip of resilient material is engaged with the water impermeable sheet material in a manner whereby the strip of resilient material cinches together at least a portion of the water impermeable sheet material around the foot-receiving opening.

In another embodiment of the present invention, a protective foot covering article comprises two adjacent layers of water impermeable sheet material. A water impermeable seam is provided between the layers of water impermeable sheet material. A shape of the water impermeable seam provides for an interior space between the layers of water impermeable sheet material. The interior space includes a closed end portion and an open end portion. A portion of the water impermeable seam defining the closed end portion of the interior space is contoured inwardly with respect to the interior space thereby providing a contoured foot arch portion. A plurality of water drainage apertures each extends through one or both of the layers. Means for cinching the open end portion of the interior space is engaged with one or both of the layers of water impermeable sheet material.

These and other objects, embodiments, advantages and/or distinctions of the present invention will become readily apparent upon further review of the following specification, associated drawings and appended claims.

BRIEF DESCRIPTION OF THE DRAWINGS

FIG. 1 is a perspective view of a protective foot covering article in accordance with the present invention.

FIG. 2 is a plan view of the protective foot covering article shown in FIG. 1.

FIG. 3 is a cross-sectional view taken along the line 3-3 in FIG. 2.

DETAILED DESCRIPTION OF THE DRAWING FIGURES

Figure 4:
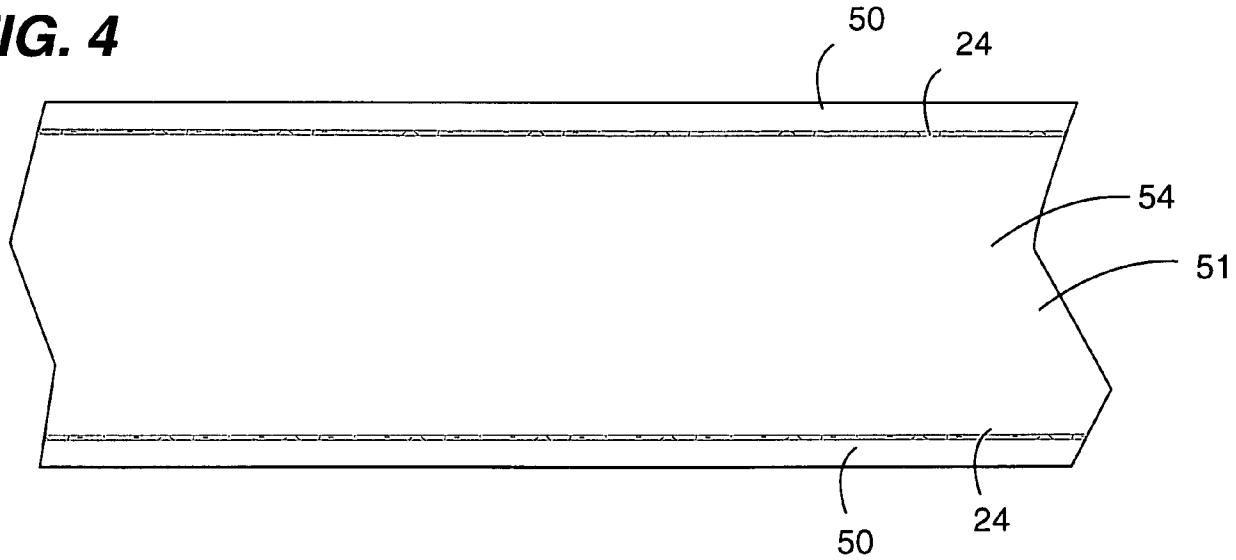
FIG. 4 is a plan view of a material structure resulting from a first manufacturing process for fabricating the protective foot covering article shown in FIG. 1.

FIGS. 1-3 show an embodiment of a protective foot covering article in accordance with the present invention, which is referred to herein as the protective foot covering article 10. The protective foot covering article 10 includes a foot cover body 12. The foot cover body 12 includes a foot-receiving opening 14, a contoured foot arch portion 16, a plurality of water drainage apertures 18 and an interior space 20. The contoured foot arch portion 16 is positioned generally opposite the foot-receiving opening 14. Each one of the water drainage apertures 18 extends through the foot cover body. The interior space 20 is accessible through the foot-receiving opening 14 thereby allowing a foot to be placed within the interior space 20.

Preferably, but not necessarily, the foot cover body 12 is made from water impermeable sheet material. In a broad sense, a sheet of non-porous polymeric sheet material will typically be a water impermeable sheet material. Specific examples of known polymeric materials that are commercially available in non-porous sheet form include, but are not limited to, polyethylene, polypropylene, polylatex, neoprene and the like.

To limit the potential for a wearer slipping on a wet floor surface while wearing the foot cover body 12, at least one major surface (i.e., side) of the water impermeable sheet material is preferably configured to exhibit substantial slip resistance characteristic. For example, all or a portion of one or both sides of the water impermeable sheet material can include texturizing features that provides for such substantial slip resistance characteristic with respect to the water impermeable sheet material in a non-textured configuration. Such texturizing features may be unitarily formed with the water impermeable sheet material (e.g., integral surface texture) or provided through application of a texturizing material or texturizing material pattern. The attribute of slip resistance is typically characterized by a relative coefficient of friction (CoF) of a subject material. For example, when a subject material is tested using a properly calibrated English XL brand Variable Incidence Tribometer in accordance with the testing method of ASTM Standard Test Method For Using a Variable Incidence Tribometer (ASTM F1679-04), a resulting CoF of at least 0.5 in wet conditions corresponds to a material that is designated a offering slip resistance characteristics.

The plurality of water drainage apertures 18 are positioned between the foot-receiving opening 14 and the contoured foot arch portion 16. The water drainage apertures 18 are spaced apart from each other along a length of the foot cover body 12 (i.e., a first reference direction). Preferably, but not necessarily, water drainage apertures 18 located adjacent end portions of the foot cover body 12 are spaced apart vertically (i.e., a second reference direction perpendicular to the first reference direction) from water drainage apertures 18 positioned between the water drainage apertures 18 located adjacent end portions of the foot cover body 12. The water drainage apertures 18 allow water to drain from the interior space 20 once a water level within the interior space 20 reaches a level of one or more of the water drainage apertures 18. To this end, for a typical range of foot sizes, one or more of the water drainage apertures 18 are preferably, but not necessarily, positioned on a floor contact portion 22 of the foot cover body 12 (i.e., a portion of the foot cover body 12 that resides under a foot within the interior space 20), just above the floor contact portion 22 or both.

The contoured foot arch portion 16 is approximately centered between opposing end portions of a foot cover body 12. The contoured foot arch portion 16 is at least partially contoured inwardly with respect to the foot-receiving opening 14. The contoured foot arch portion 16 limits excess material gathering within the arch area of a wearer's foot. In doing to, the protective foot covering article 10 advantageously offers more natural and form-fitting engagement with the wearer's foot. Such a natural and form-fitting engagement is advantageous as it enhances non-slip characteristics, comfort and overall desirability of wearing a protective foot covering article in accordance with the present invention.

As depicted in FIG. 3, the protective foot covering article 10 includes a strip 24 of resilient material that is engaged with the foot covering body 12. In one embodiment, the foot cover body 12 includes an elongated pocket 26 extending at least partially around the foot-receiving opening 14 and the strip of resilient material 14 is disposed within the elongated pocket 26. The strip 24 of resilient material is engaged within the elongated pocket 26 in a manner whereby the strip 24 of resilient material cinches together at least a portion of the water impermeable sheet material surrounding the foot-receiving opening 14. For example, opposing end portions of the strip 24 of resilient material can be attached to the foot cover body 12 with the strip 24 of resilient material in a tensioned state such that when relaxed toward a recovered state a cinching force is applied by the strip 24 of resilient material. Such an implementation of the strip 24 of resilient material is one embodiment of a means for cinching the water impermeable sheet material surrounding the foot-receiving opening 14. In another embodiment, the strip 24 of resilient material is omitted and the water impermeable sheet material itself offers resiliency suitable for cinching the water impermeable sheet material surrounding the foot-receiving opening 14, for cinching the water impermeable sheet material around a wearer's foot or both.

In one embodiment, the foot cover body 12 includes two adjacent layers (28, 30) of the water impermeable sheet material, as is shown best in FIGS. 2 and 3. A water impermeable seam 32 is provided between the two adjacent layers of the water impermeable sheet material. A shape of the water impermeable seam 32 (FIG. 2) results in the interior space 20 being formed between the layers (28, 30) of the water impermeable sheet material. The interior space 20 includes a closed end portion 34 and an open end portion 36. A central portion 38 (FIG. 2) of the water impermeable seam 32 defining the closed end portion 36 is contoured inwardly with respect to the interior space 20 thereby providing the contoured foot arch portion 16.

Referring now to FIGS. 4-7, an embodiment of a method of fabricating the protective foot covering article 10 is shown. As shown in FIG. 4, the strip 24 of resilient material is aligned with each side edge portion 50 of a strip 51 of water impermeable sheet material. The strip 51 of water impermeable sheet material is held in a tensioned state such that it maintains a generally flat configuration and each one of the strips 24 of resilient material is held in a tensioned state such that they are elastically stretched with respect to respective fully relaxed states. Elastic strip material and rubber bands are two examples of the strip 24 of resilient material.

Figure 5:
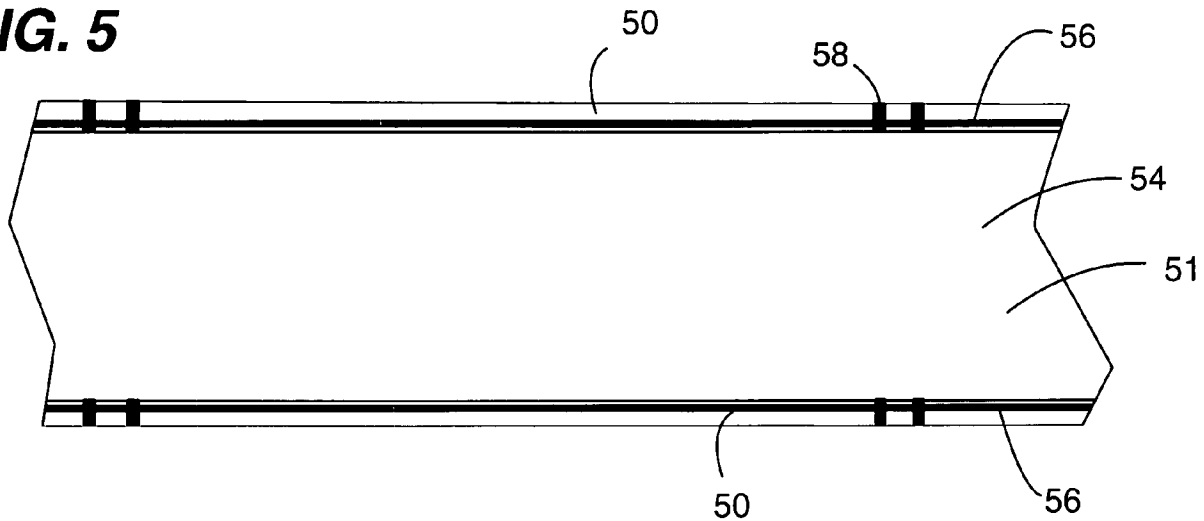
FIG. 5 is a plan view of a material structure resulting from a second manufacturing process for fabricating the protective foot covering article shown in FIG. 1.

As shown in FIG. 5, each side edge portion 50 is folded over the respective strip 24 of resilient material. Thermal boding means such as, for example, ultrasonic welding or thermal bonding is used to bond each folded side edge portion 50 to the central portion 54 of the strip 51 of water impermeable sheet material along an edge bond interface 56. The central portion 54 is the portion of the water impermeable sheet material 51 between the spaced apart strips 24 of resilient material. As is also shown in FIG. 5, the strips 24 of resilient material are thermally bonded to the water impermeable sheet material at a plurality of discrete bond points 58. In this manner, the elongated pocket 26 (best shown in FIG. 3) is created along each side edge portion 50 of the strip 51 of water impermeable sheet material.

Figure 6:
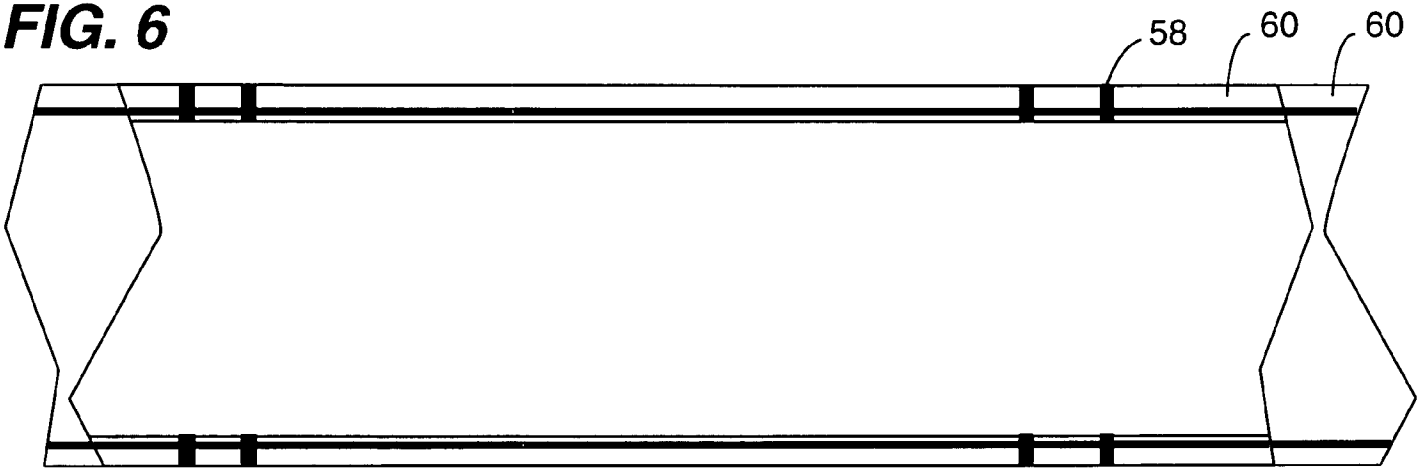
FIG. 6 is a plan view of a material structure resulting from a third manufacturing process for fabricating the protective foot covering article shown in FIG. 1.
Figure 7:
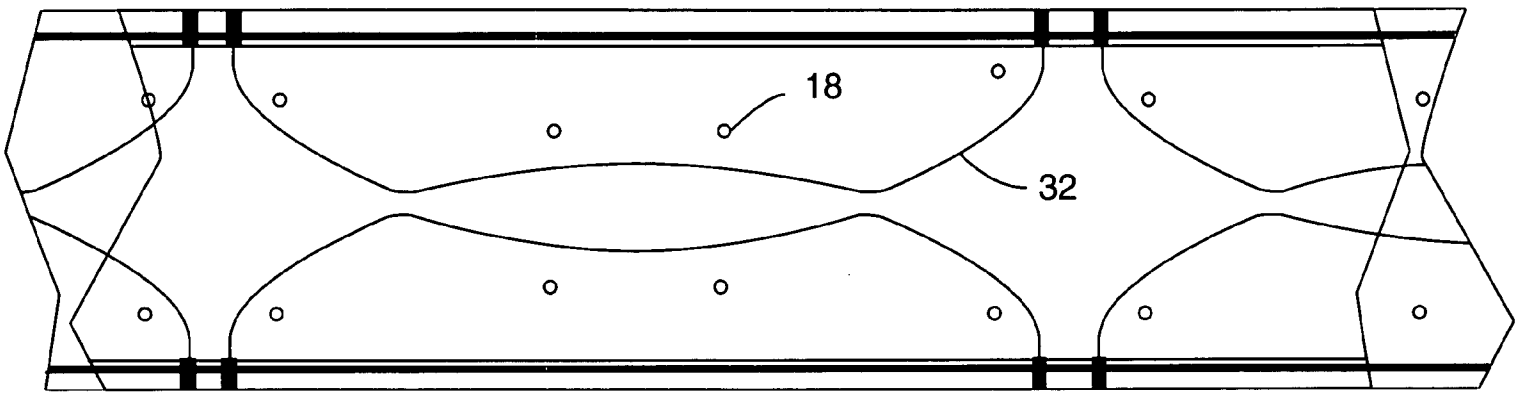
FIG. 7 is a plan view of a material structure resulting from a fourth manufacturing process for fabricating the protective foot covering article shown in FIG. 1.

The length of processed material shown is FIG. 5 is input material for subsequent fabrication operations. Referring now to FIG. 6, two lengths 60 of the input material shown in FIG. 5 are brought together in face-to-face contact. The two lengths 60 of the input material are aligned such that the discrete bond points 58 of the two lengths 60 of the input material length are aligned (i.e., overlapping). As shown in FIG. 7, a thermal bonding operation (e.g., through the use of a heated bonding die) is performed for forming instances of the water impermeable seam 32 (also shown in FIGS. 2 and 3) between the lengths 60 of input material. Thereafter, a trimming process (e.g., though the use of a steel rule or rotary cutting die) is performed for excising individual foot covering articles 10 (FIG. 2) from the adjoined lengths 60 of input material length. During or prior to the trimming process, the water drainage apertures 18 are formed in one or both of the adjoined lengths 60 of input material. For example, aperture punching or cutting features may be included on the heated bonding die or the cutting die. It is disclosed herein that the various operations of this method can be performed manually, performed in a continuous web fashion (e.g., rotary press) or performed using a combination of manual and machine-implemented operations.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A protective foot covering article, comprising:

a foot cover body including two layers of water impermeable sheet material adjoined to each other along a length of a perimeter edge portion thereof such that an interior space is defined between said overlapping layers, wherein a first length of the perimeter edge portion of each one of said layers of material are not adjoined to each other thereby providing a foot-receiving opening into the interior space, wherein a second length of the perimeter edge portion of each one of said layers of material generally opposite the first length thereof are adjoined to each other and each include an arcuate shaped segment forming a contoured foot arch portion, and wherein at least one of said layers of material includes at least one water drainage aperture extending therethrough.

2. The protective foot covering article of claim 1 wherein:

a plurality of water drainage apertures are positioned between the foot-receiving opening and the contoured foot arch portion; and said water drainage apertures are spaced apart from each other along a first reference direction.

3. The protective foot covering article of claim 2 wherein a first portion of the plurality of water drainage apertures is spaced apart from a second portion of the plurality of water drainage apertures in a second reference direction perpendicular to the first reference direction.

4. The protective foot covering article of claim 1, further comprising:

a strip of resilient material engaged with the water impermeable sheet material for cause at least a portion of said water impermeable sheet material to be cinched.

5. The protective foot covering article of claim 1 wherein said water impermeable sheet material is polymeric sheet material.

6. The protective foot covering article of claim 5 wherein at least one major surface of said polymeric sheet material is textured such that said at least one major surface of said polymeric sheet material exhibits substantial slip resistance characteristic with respect to said polymeric sheet material in a non-textured configuration.

7. The protective foot covering article of claim 5 wherein:

the contoured foot arch portion is approximately centered between opposing end portions of the foot cover body; and the contoured foot arch portion is contoured inwardly with respect to the foot-receiving opening.

8. A protective foot covering article, comprising:

a foot cover body including two discrete pieces of water impermeable sheet material attached to each other along a portion of adjacent perimeter edge portions thereof such that an interior space is provided between said pieces of material and a foot-receiving opening through which the interior space is accessible is provided, wherein at least one water drainage aperture extends through at least one of said pieces of material and wherein said attached perimeter edge portion of at least one of said pieces of material includes an arcuate shaped segment forming a contoured foot arch portion positioned generally opposite the foot-receiving opening; and a strip of resilient material extending at least partially around the foot-receiving opening, wherein the strip of resilient material is engaged with the said water impermeable sheet material in a manner whereby the strip of resilient material cinches together at least a portion of said water impermeable sheet material around the foot-receiving opening.

9. The protective foot covering article of claim 8 wherein:

a plurality of water drainage apertures are positioned between the foot-receiving opening and the contoured foot arch portion; and said water drainage apertures are spaced apart from each other along a first reference direction.

10. The protective foot covering article of claim 9 wherein a first portion of the plurality of water drainage apertures is spaced apart from a second portion of the plurality of water drainage apertures in a second reference direction perpendicular to the first reference direction.

11. The protective foot covering article of claim 8 wherein:

the foot cover body includes an elongated pocket extending at least partially around the foot-receiving opening; and the strip of resilient material is disposed within the elongated pocket.

12. The protective foot covering article of claim 8 wherein said water impermeable sheet material is polymeric sheet material.

13. The protective foot covering article of claim 12 wherein at least one major surface of said polymeric sheet material is textured such that said at least one major surface of said polymeric sheet material exhibits substantial slip resistance characteristic with respect to said polymeric sheet material in a non-textured configuration.

14. The protective foot covering article of claim 12 wherein:

the contoured foot arch portion is approximately centered between opposing end portions of the foot cover body; and the contoured foot arch portion is contoured inwardly with respect to the interior space.

15. A protective foot covering article, comprising:

two adjacent layers of water impermeable sheet material;

wherein a water impermeable seam is provided between said layers of water impermeable sheet material;

wherein a shape of the water impermeable seam provides for an interior space between said layers of water impermeable sheet material;

wherein the interior space includes a closed end portion and an open end portion;

wherein a portion of the water impermeable seam defining the closed end portion of the interior space is formed between an arcuate shaped segment of a perimeter edge portion of each one of said pieces of water impermeable sheet material such that a portion of the water impermeable seam defining the closed end portion of the interior space is contoured with respect to the interior space thereby providing a contoured foot arch portion;

wherein a plurality of water drainage apertures extend through at least one of said layers; and wherein means for cinching the open end portion of the interior space is engaged with at least one of said layers of water impermeable sheet material.

16. The protective foot covering article of claim 15 wherein the contoured foot arch portion is approximately centered between opposing end portions of a foot cover body.

17. The protective foot covering article of claim 16 wherein a first portion of the plurality of water drainage apertures is spaced apart from a second portion of the plurality of water drainage apertures in a second reference direction perpendicular to the first reference direction.

18. The protective foot covering article of claim 17 wherein said water impermeable sheet material is polymeric sheet material.

19. The protective foot covering article of claim 18 wherein at least one major surface of said polymeric sheet material is textured such that said at least one major surface of said polymeric sheet material exhibits substantial slip resistance characteristic with respect to said polymeric sheet material in a non-textured configuration.

20. The protective foot covering article of claim 19 wherein said means for cinching includes a strip of resilient material engaged with at least one of said layers of water impermeable sheet material adjacent the open end portion of the interior space.

* * * * *